US009233821B2

(12) United States Patent
Huitorel et al.

(10) Patent No.: US 9,233,821 B2
(45) Date of Patent: Jan. 12, 2016

(54) FILLING DEVICE HAVING A SPECIAL VALVE SYSTEM

(75) Inventors: Mickaël Huitorel, Octeville-Sur-Mer (FR); Arnaud Pasquet, Octeville-Sur-Mer (FR)

(73) Assignee: SIDEL PARTICIPATIONS, Octeville-sur-Mer (FR)

( * ) Notice: Subject to any disclaimer, the term of this patent is extended or adjusted under 35 U.S.C. 154(b) by 512 days.

(21) Appl. No.: 13/508,148

(22) PCT Filed: Nov. 3, 2010

(86) PCT No.: PCT/EP2010/066708

§ 371 (c)(1),
(2), (4) Date: May 4, 2012

(87) PCT Pub. No.: WO2011/054850

PCT Pub. Date: May 12, 2011

(65) Prior Publication Data

US 2012/0234435 A1 Sep. 20, 2012

(30) Foreign Application Priority Data

Nov. 4, 2009 (FR) ..... 09 57798

(51) Int. Cl.
*B67C 3/00* (2006.01)
*B67C 3/26* (2006.01)
*B67C 3/28* (2006.01)

(52) U.S. Cl.
CPC ..... *B67C 3/2608* (2013.01); *B67C 3/286* (2013.01)

(58) Field of Classification Search
CPC ..... B67C 3/26; B67C 3/286; B67C 3/2608; B65B 3/00; B65B 3/06
USPC ..... 141/192, 298, 286; 239/440, 441
See application file for complete search history.

(56) References Cited

U.S. PATENT DOCUMENTS 1,893,298 A * 1/1933 Moore ..... 239/441
2,529,223 A * 11/1950 Moen ..... 239/440
5,271,226 A * 12/1993 Stone ..... 60/233

(Continued)

FOREIGN PATENT DOCUMENTS

CN 1022390 C 10/1993
DE 2246176 A1 4/1974
DE 3022413 A1 1/1982
EP 0374549 A2 6/1990

(Continued)

OTHER PUBLICATIONS

Chinese Office Action (with English translation) in corresponding application issued Jun. 21, 2013.

*Primary Examiner* — Jason K Niesz
*Assistant Examiner* — Andrew St. Clair
(74) *Attorney, Agent, or Firm* — Bachman & LaPointe, P.C.

(57) ABSTRACT

A device for filling containers includes a filling spout fitted with a valve system for minimizing the formation of drops after being closed. The valve system includes a cylindrical central valve moveably mounted in a main tubular valve. A control system enables, on the one hand, the main valve to move relative to a main seat of the spout in order to open or close the discharge aperture of the spout, and on the other hand, to move the central valve relative to a secondary seat of the main valve in order to open or close the secondary aperture of the latter. The lower edge of the main valve is provided with radial grooves extending over the inner surface thereof, wherein in the grooves the filling substance on the lower edge of the central valve can migrate via capillarity.

8 Claims, 3 Drawing Sheets

(56) References Cited

U.S. PATENT DOCUMENTS

| | | | | |
|---|---|---|---|---|
| 5,979,800 | A * | 11/1999 | Takagi | 239/440 |
| 6,641,061 | B1 * | 11/2003 | Hsieh | 239/526 |
| 6,783,087 | B2 * | 8/2004 | Aoki et al. | 239/596 |
| 7,036,536 | B1 * | 5/2006 | Knight et al. | 141/86 |
| 7,234,614 | B1 * | 6/2007 | Knight et al. | 222/566 |
| 7,360,721 | B2 * | 4/2008 | Hofer | 239/437 |
| 2004/0154695 | A1 * | 8/2004 | Petit | 141/129 |

FOREIGN PATENT DOCUMENTS

| | | | |
|---|---|---|---|
| EP | 0919472 | * | 10/1998 |
| EP | 1000898 | * | 11/1999 |
| FR | 2791033 | A1 | 9/2000 |
| FR | 2861716 | A1 | 5/2005 |
| FR | 2905121 | A1 | 2/2008 |
| JP | 2005343516 | A | 12/2005 |
| WO | 0140098 | A1 | 6/2001 |

* cited by examiner

FILLING DEVICE HAVING A SPECIAL VALVE SYSTEM

BACKGROUND

This invention relates to a filling device comprising a filling spout and means of metering, intended to be fitted to a machine for filling, for the filling of containers, such as bottles or pots, with any sort of products, liquids to viscous, in particular a food product. The invention relates in particular to a filling device with means of metering comprising a valve system making it possible to limit the formation of drops after being closed.

Such devices for filling conventionally include a filling spout and means of metering to deliver a determined quantity of filling product in a container placed under the filling spout.

The filling spout comprises a globally tubular body having an internal passage with a longitudinal axis, an open lower axial end constituting the discharge aperture of the filling spout and a supply aperture for its supply of filling liquid. The means of metering include a closing valve system mounted movably in the filling spout, and a control system able to longitudinally displace said valve system for closing or opening the discharge aperture. The valve control system conventionally comprises a cylinder of which the rod passes through an open upper end of the tubular body of the spout, the valve system comprises a valve connected to the free end of the cylinder rod. The inner surface of the tubular body of the filling spout comprises a portion, generally tapered, defining a valve seat. The control system displaces the valve between a closed state wherein the latter comes via a tapered closing portion of its exterior surface against the valve seat and an open state wherein said closing portion is separated from said seat.

These devices for filling must prevent as much as possible drops from forming on the lower edge of the valve after the closing of the latter, and from falling from the filling spout onto the containers to be filled and/or onto the machine. When the valve is closed, a certain quantity of filling product can remain under the valve, on its lower edge. The higher the diameter of the valve, the higher the quantity of product present under the valve at the time of closing, and with it the risks of drops forming and falling. On a machine for filling of the rotating type, the centrifugal force accentuates these risks.

In order to prevent drops from falling after the filling, after the closing of the valve, it has been proposed to provide grids, downstream of the valve, on the discharge aperture, in order to retain the drops of filling product via capillarity. This solution cannot be used for certain filling products, in particular viscous products or those comprising particles and/or pieces.

Another solution consists in providing a valve geometry allowing for a retaining of the drops via capillarity. For example, such as described in patent document FR 2 861 716, the valve at closed state can define with the filling spout an annular space wherein the filling product is retained via capillarity. Such as described in patent document JP 2005-343516, the valve can also be provided on its lower end edge with ribs defining between them housings wherein the product is retained via capillarity.

Another solution, described for example in patent document FR 2 791 033, consists in providing a recess on the lower end edge of the valve wherein means of suction are arranged to suck and as such retain the filling liquid after closing of the valve.

SUMMARY OF THE INVENTION

The purpose of this invention is to propose a new solution for limiting the risks of falling drops, in particular in the case of a filling spout of which the discharge aperture has a substantial diameter.

To this effect, this invention proposes a filling device, intended to be used in machines for filling for the filling of containers with a filling product, comprising

- a filling spout comprising a globally tubular body having an internal passage with a longitudinal axis and an open lower axial end constituting the discharge aperture of the filling spout and a supply aperture for its supply of filling liquid, the inner surface of the tubular body comprising a lower portion extending to the discharge aperture comprising a portion, more preferably tapered, defining a main valve seat,
- means of metering comprising a valve system mounted movably in the filling spout, and a control system able to longitudinally displace said valve system between a close state wherein the valve system comes via a main closing portion, more preferably tapered, of its exterior surface against the main seat in order to close the discharge aperture, and at least one open state wherein said main closing portion is separated from said main seat in order to open the discharge aperture, characterized in that said valve system comprises

- a first tubular valve, called main valve, comprising a lower annular edge delimiting a lower aperture, called secondary aperture, its outer surface comprising a lower portion that extends to said lower edge and which comprises said main closing portion, its inner surface comprising a lower portion extending to said lower edge comprising a portion, more preferably tapered, forming a valve seat, called secondary valve seat, and
- a second cylindrical valve, called central valve, mounted movably in the main valve, and comprising a lower end edge, its outer surface comprising a lower portion which extends to said lower end edge and which comprises a closing portion, called secondary closing portion, more preferably tapered, said control system being able

- to displace the main valve between a closed position, wherein its main closing portion is against the main seat, and at least one open position wherein its main closing portion is separated from the main seat,
- and to displace the central valve between a closed position wherein its secondary closing portion is against the secondary seat and at least one open position wherein its secondary closing portion is separated from the secondary seat,
- said main valve comprising at least one opening guaranteeing a fluid communication between its internal passage and the internal passage of the spout,
- said lower edge of the main valve being provided with grooves, more preferably radial, exiting onto the inner surface of said main valve, as well as, more preferably, onto the outer surface of said main valve, in such a way that, when the central valve is displaced to its closed position, the filling product present on the lower edge of the central valve is displaced via capillarity into said grooves of the main valve in closed position.

The filling device according to the invention makes it possible to prevent drops from falling at the end of filling, while still having a substantial discharge aperture diameter. The filling device can be used for liquid products, such as water, to semi-liquid products, such as oil or washing liquid for example.

According to a particularity, for the passing from a high flow open state of the valve system wherein the main valve and the central valve are in their open position, to the closed state of the valve system wherein the main valve and the central valve are in their closed position, the control system is able in a first step to displace the main valve to its closed position, in a low flow open state of the valve system, in such a way that the major portion of the filling product present in said grooves is sucked by the venturi effect by the flow of filling product passing through the secondary aperture of said main valve, then to displace the central valve to its closed position, the filling product present on the lower edge of the central valve being displaced via capillarity in said grooves.

According to a particularity, the lower portion of the outer surface of the main valve comprises a substantially cylindrical final portion, that extends from the main closing portion to said lower edge and whereon exits said grooves, the lower portion of the inner surface of the tubular body comprising a final portion that extends from the main seat to the main aperture, said final portions defining together, in the closed position of the main valve, a first annular space. The grooves exit as such, in the closed position of the main valve, onto this annular space which constitutes an additional retaining zone for the filling product present on the lower edge of the central valve during the closing of the latter.

According to a particularity, the lower portion of the inner surface of the main valve comprises a final portion that extends from the secondary seat to said lower edge, and whereon exit the grooves, the lower portion of the exterior surface of the central valve comprising a final portion that extends from said secondary closing portion to the lower end edge, said final portions defining together, in the closed position of the central valve and of the main valve, a second annular space. The grooves as such exit in the closed position of the valves onto this second annular space. This second annular space that connects the grooves, allows for a good distribution of the filling product in all of the grooves during the closing of the central valve, and constitutes an additional retaining zone.

According to a particularity, the lower edge of the central valve has a planar surface, substantially perpendicular to the longitudinal axis of the central valve, or a tapered surface, of which the cone angle is more preferably between 179° and 120°, for example of a magnitude of 150°, with the major portion of this tapered surface being arranged inside the main valve, set back from the lower edge of the main valve.

According to an embodiment, the control system comprises

- a valve rod extending substantially axially in the tubular body, the central valve being mounted at the lower end of the valve rod, the main valve being assembled to a bushing mounted slidingly on the valve rod between said central valve and a shoulder of said rod,
- a spring being mounted between the bushing and said shoulder in order to elastically solicit said bushing in the direction of the central valve, and
- a control member, such as a cylinder, able to displace the valve rod between a low position wherein the central valve is in its closed position and the main valve is elastically solicited by the spring in its closed position, an intermediary position wherein the central valve is in an open position and the main valve is elastically solicited by the spring in its closed position, and a high position wherein the central valve is in an open position in abutment against the bushing and the main valve in open position.

BRIEF DESCRIPTION OF THE DRAWINGS

The invention shall be better understood, and other purposes, details, characteristics and advantages shall appear more clearly in the following detailed explanatory description of a currently preferred particular embodiment of the invention, in reference to the annexed diagrammatical drawings, wherein.

DETAILED DESCRIPTION OF THE PREFERRED EMBODIMENT(S)

Figure 1:
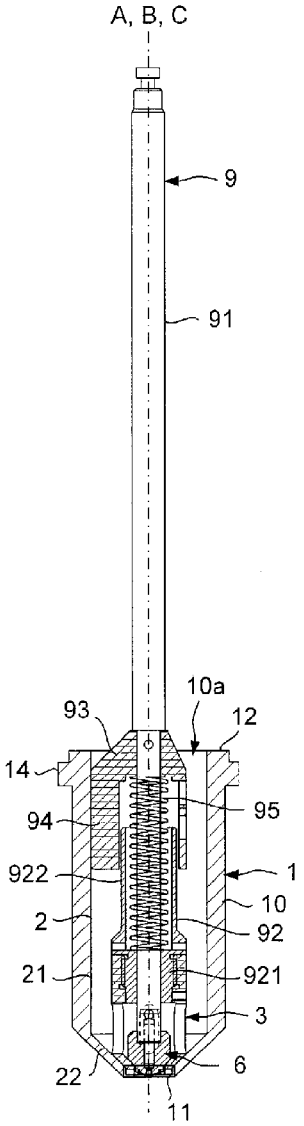
FIG. 1 is a longitudinal cross-section view of a filling device according to the invention, with the main valve and the central valve in their closed position.
Figure 3:
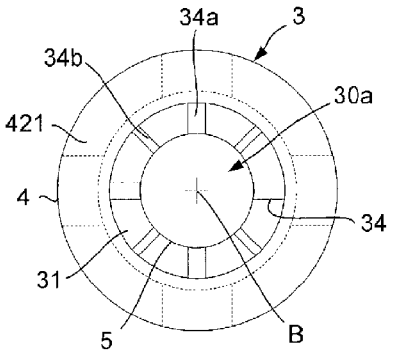
FIG. 3 is a bottom view of the main valve.

In reference to FIGS. 1 and 3, the filling device comprises a filling spout 1 with a discharge aperture 11 and means of metering in order to deliver a determined quantity of filling product into each container brought under the filling spout.

The filling spout 1 is formed from a globally tubular body 10, with longitudinal axis A, having an inner passage 10*a*, an upper open axial end 12 and an open lower axial end constituting the discharge aperture 11 of the filling spout. The tubular body is provided with, in the vicinity of its upper axial end, an assembly collar 14. The tubular body can be mounted directly on the rigid bottom wall of the tank of a machine for filling, for example of the rotating type, with its open upper axial end then constituting the supply aperture of the spout, or be assembled to a another portion of the filling spout, by which said spout will be assembled to a support structure of the machine for filling, and connected to a tank on board the machine or an offset tank.

The inner surface 2 of the tubular body comprises, from the upper axial end 12 to the discharge aperture 11, a substantially cylindrical upper portion 21, and a lower portion 22 comprising a tapered portion, which converges in the direction of the discharge aperture, and which defines a main valve seat 221, being extended by a substantially cylindrical final portion 222.

The means of metering include a valve system 3, 6 arranged in the filling spout and a control system 9 making it possible to displace the valve system in order to close and open the discharge aperture.

The valve system is of the double valve type, and comprises a first tubular valve, called main valve 3, and a second central cylindrical valve, called central valve 6, mounted movably in the main valve.

Figure 2:
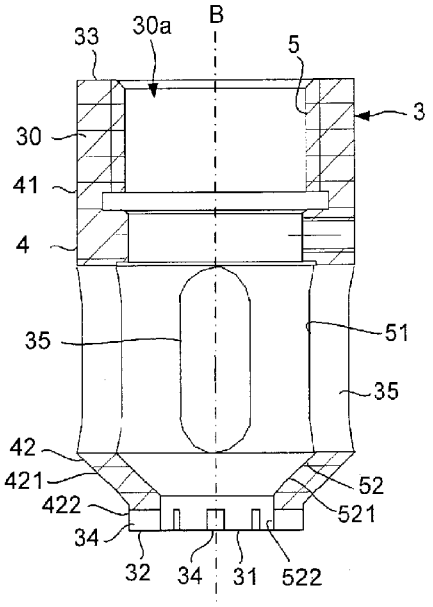
FIG. 2 is an enlarged view of the main valve of FIG. 1.

In reference in particular to FIGS. 2 and 3, the main valve 3 is formed from a tubular body 30, with a longitudinal axis B, open at its two axial ends, having a lower annular edge 32 delimiting a lower, secondary, aperture 31, of the main valve, and an upper annular edge 33.

Its outer surface 4 comprises, from the upper edge 33 to the lower edge 32, a substantially cylindrical upper portion 41 and a lower portion 42 which comprises a main tapered closing portion 421, which converges towards the discharge aperture and of which the taper corresponds substantially to that of the main seat 221, and a substantially cylindrical final portion 422.

Its inner surface 5 comprises, from the upper edge 33 to the lower edge 32, a substantially cylindrical upper portion 51 and a lower portion 52 which comprises a tapered portion, which converges towards the discharge aperture and which forms a secondary valve seat 521 for the central valve, and a substantially cylindrical final portion 522.

In this embodiment, the tubular body is formed from a tubular wall comprising a cylindrical section defining interiorly and exteriorly said upper cylindrical portions 41, 51 of the inner and outer surfaces, a tapered section defining said main closing portion 421 and said secondary seat 521 and a cylindrical section defining said cylindrical final portions 422, 522.

The lower edge 32 is provided with radial grooves 34 exiting onto the final portions 422, 522 of the outer surface and the inner surface.

Figure 4:
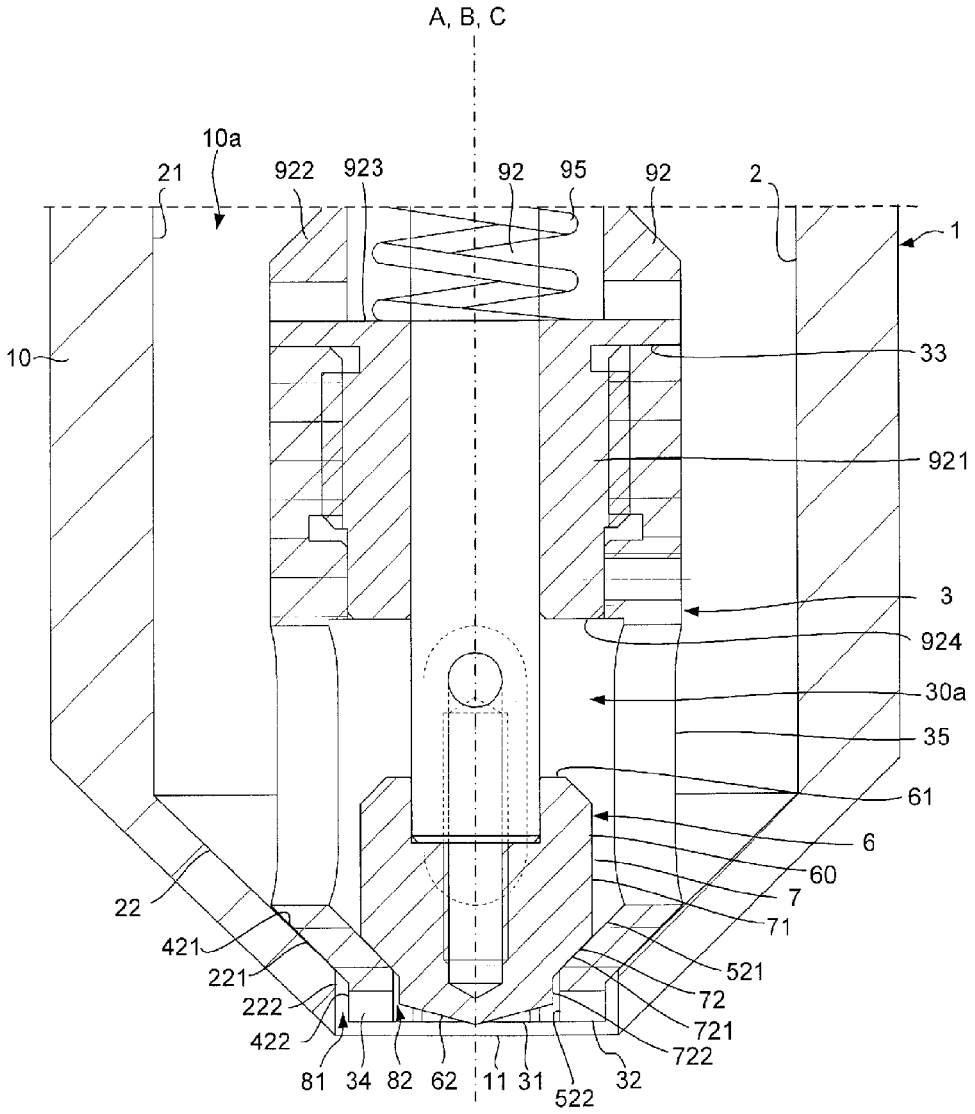
FIG. 4 is a partial enlarged view of FIG. 1.

In reference to FIG. 4, the central valve 6 is formed from a solid cylindrical body 60, with longitudinal axis C, having an upper end edge 61 and a lower end edge 62.

Its exterior surface 7 comprises, from its upper end edge to its lower end edge, a globally cylindrical upper portion 71 and a lower portion 72 comprising a secondary tapered closing portion 721 which converges towards its lower end edge and of which the taper corresponds substantially to that of the secondary seat 521, and a substantially cylindrical final portion 722.

The lower end edge 62 has a tapered surface that converges downwards.

Figure 5:
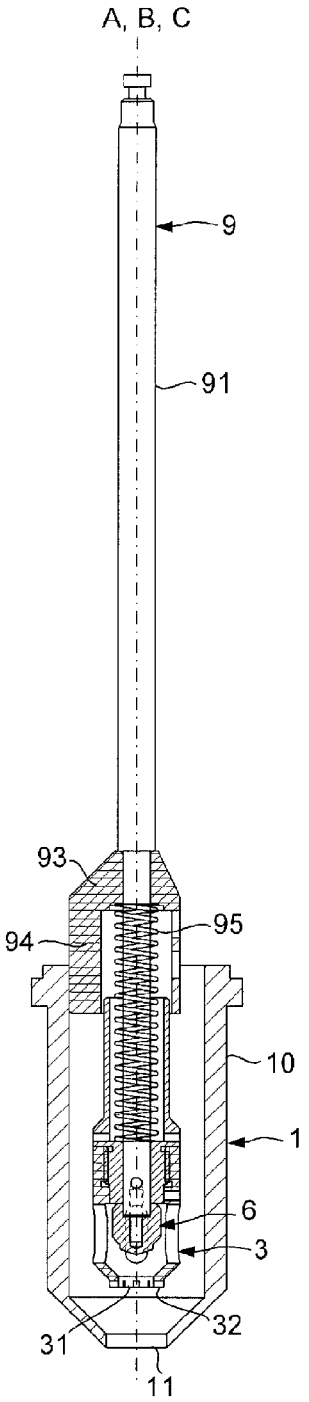
FIG. 5 is a view analogous to that of FIG. 1, with the main valve and the central valve in their open position, and, FIG. 6 is a view analogous to those of FIGS. 1 and 5, with the valve in closed position and the central valve in open position.
Figure 6:
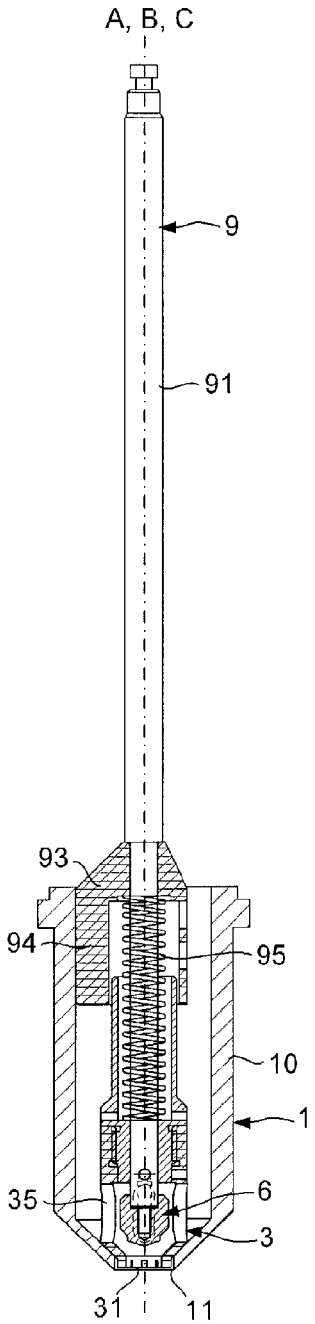

According to FIGS. 1, 5 and 6, the control system 9 comprises a valve rod 91 at the lower end of which is assembled the central valve 6. The main valve 3 is mounted slidingly on the rod 91. To do this, the main valve is assembled to a bushing 92 comprising a lower portion 921 whereon is screwed the main valve, via its upper edge, and an upper portion 922. The valve rod 91 slides in the internal passage of the lower portion of the bushing.

The valve rod 91 is provided with a ring 93 comprising an annular base via which the ring is fixed on the rod, said base carrying on the lower side a tubular wall provided with radial centering vanes 94 for centering the rod in the internal passage of the spout and as such guarantee a coaxial positioning of the main valve and of the central valve in the filling spout.

A spring 95 is mounted on the valve rod between a fixed shoulder of the valve rod, formed here by the annular base of the ring 93, and an inner shoulder 923 of the bushing. This spring, of the compression spring type, tends to separate the bushing 92 from the ring 93, and therefore elastically solicits the bushing by placing it in abutment by its lower edge 924 against the upper edge 61 of the central valve.

The main valve has radial openings 35, exiting onto the upper cylindrical portions 41, 51 of the inner and outer des surfaces, under the bushing, in order to provide for the fluid communication between the inner passage 30*a* of the main valve and between the inner passage 10*a* of the filling spout.

The valve rod is connected to a control member (not shown) of the control system, such as a cylinder for example pneumatic, with the upper end of the cylinder rod then being assembled to the upper end of the cylinder rod.

In a closed state of the valve system shown in FIGS. 1 and 6, the main valve is in a closed position wherein the main closing portion 421 of its outer surface is against the main seat 221, the final portion 422 of its outer surface is separated from the final portion 222 of the inner surface of the spout, and defines with the latter a first annular space 81 whereon exits the grooves 34. Its lower edge 32 is arranged in the spout, slightly set back from the discharge aperture 11.

The central valve is in a closed position wherein the secondary closing portion 721 of its outer surface is against the secondary seat 521 of the inner surface of the main valve. The final portion 722 of its outer surface is slightly separated from the final portion 522 of the inner surface of the main valve and defines with the latter a second annular space 82 whereon exit the grooves 34. The lower end edge 62 is arranged substantially in the main valve, the top of its cone being substantially arranged on the lower edge 31 of the main valve. In this closed state of the valve system, the rod is in a low position.

The displacement upwards of the rod in an intermediary position, via the control member, has for effect to separate the central valve of the secondary seat, in an open position shown in FIG. 6, the main valve being maintained in closed position by the spring 95. In this intermediary state, referred to as low flow, of the valve system, the filling device allows for the filling of the container with a low flow, the filling product brought in the spout passes through openings 35 and flows through the secondary aperture 31 of the main valve.

The additional displacement upwards of the valve rod into a high position, via the control member, drives the central valve upwards. During this displacement, the central valve comes via its upper end edge 61 against the lower edge 924 of the bushing, and drives the latter upwards. The main valve assembled to the bushing then separates from the main seat to its open position shown in FIG. 5. The valve system is then in a high flow open state, with the filling product flowing through the discharge aperture 11 of the spout.

During these displacements, the upper portion 922 of the bushing 92 is arranged in the ring 93 and slides along the tubular wall of the latter.

The means of metering are for example of the weight-based type, with the control member being controlled by a weighing sensor which is placed on a container support device. Alternatively, the control member is controlled by a filling level detection sensor of the container or a flow sensor being inserted between the container and the spout at the time of the filling, or via a volumetric system.

The operation of the system shall now be described in reference to FIGS. 1, 3, 5 and 6.

For the filling of a container, the valve system initially in its closed state of FIG. 1, is brought to its low flow open state of FIG. 6 in order to start the filling with a low flow, then to its high flow open state shown in FIG. 5. Alternatively, the valve system can be brought directly from its closed state to high flow open state in order to directly start the filling with a high flow.

At the end of filling, the valve system is brought to its low flow open state shown in FIG. 6. The quantity of filling product present in the first annular space 81 and in the grooves 34 is for the most part sucked, via the venturi effect, by the flow of filling product passing through the secondary aperture 31 of said main valve. The valve system is maintained in this low flow open state over a duration of time that is sufficient to suck and evacuate the filling product.

The valve system is then brought in its closed state shown in FIGS. 1 and 3. The small quantity of filling product present on the lower edge 62 of the central valve migrates via capillarity in the grooves connected together by the second annular space 82, then in the first annular space 81, as such guaranteeing that no drop falls.

The grooves 34 and the annular spaces 81, 82 are sized in such a way as to define a retention volume that is sufficient to contain the quantity of filling product able to be retained under the central valve during its closing. By way of example, in reference to FIG. 3, the lower edge 32 comprises for example four first grooves 34*a* arranged at 90° from each other, and four second grooves 34*b*, of less substantial dimensions than those of the first grooves, arranged between the latter at 45°. Moreover, the taper of the lower end edge is defined so as to be able to allow for a migration via capillarity of the filling product that remained under the central valve 6 towards the grooves.

The filling device according to the invention can also be used for a filling carried out solely via low flow, with the valve system in the low flow open state.

In an alternative, the control system comprises a solid control rod carrying at the lower end the central valve, as previously, as well as a hollow control rod carrying at the lower end the main valve, wherein slides the solid rod. The bushing carrying the centering vanes is mounted on the hollow rod. Each control rod is then assembled at the upper end of a control member pour son displacement between its open position and its closed position.

Although the invention has been described in liaison with a particular embodiment, it is obvious that it is in no way limited to this and that it comprises all of the technical equivalents of the means described as well as combinations thereof if the latter fall within the scope of the invention.

The invention claimed is:

1. A filling device comprising:

a filling spout comprising a tubular body, said tubular body having an inner passage with a longitudinal axis and an open lower axial end constituting a discharge aperture of the filling spout, an inner surface of the tubular body comprises a lower portion, said lower portion comprising a portion defining a main valve seat, means for metering comprising a valve system mounted movably in the filling spout, and a control system able to longitudinally displace said valve system between a closed state wherein the valve system comes via a main closing portion of an exterior surface against the main valve seat in order to close the discharge aperture, and at least one open state wherein said main closing portion is separated from said main valve seat, wherein said valve system comprises a first tubular main valve, said main valve comprising a lower annular edge delimiting a lower secondary aperture, an outer surface comprising a lower portion that extends to said lower edge and which comprises said main closing portion, said main valve having an inner surface comprising a lower portion extending to said lower annular edge, said lower portion comprising a portion forming a secondary valve seat, and a second cylindrical central valve, mounted movably in the main valve, said central valve comprising a lower end edge, said central valve having an exterior surface, said exterior surface comprising a lower portion that extends to said lower end edge and which comprises a secondary closing portion, said control system being able to displace the main valve between a closed position, wherein said main closing portion is against the main valve seat, and at least one open position wherein said main closing portion is separated from the main valve seat, and able to displace the central valve between a closed position wherein a secondary closing portion is against the secondary valve seat and at least one open position wherein said secondary closing portion is separated from the secondary valve seat, said main valve comprising at least one opening guaranteeing a fluid communication between an inner passage and the inner passage of the spout, and said lower edge of the main valve being provided with radial grooves, exiting onto the inner surface of said main valve, said radial grooves being spaced apart from each other in a circumferential pattern along said lower edge of the main valve, said radial grooves being configured so that when the central valve is moved to its closed position, a filling product present on the lower edge of the central valve is displaced via capillarity into said grooves of the main valve in the closed position.

2. The filling device according to claim 1, wherein for passing from a high flow open state of the valve system wherein the main valve and the central valve are in an open position, to the closed state of the valve system wherein the main valve and the central valve are in a closed position, the control system is able in a first step to displace the main valve to said closed position, in a low flow open state of the valve system, then to displace the central valve to said closed position.

3. The filling device according to claim 1, wherein the lower portion of the outer surface of the main valve comprises a substantially cylindrical final portion, which extends from the main closing portion to said lower edge and whereon exit said grooves, the lower portion of the inner surface of the tubular body comprises a final portion that extends from said main seat to the main aperture, and said final portions define together, in the closed position of the main valve, a first annular space.

4. The filling device according to claim 1, wherein the lower portion of the inner surface of the main valve comprises a final portion that extends from the secondary seat to said lower edge, and whereon exit the grooves, the lower portion of the exterior surface of the central valve comprising a final portion that extends from said secondary closing portion to the lower end edge, and said final portions defining between them, in the closed position of the central valve and of the main valve, a second annular space.

5. The filling device according to claim 1, wherein the lower edge of the central valve has a tapered surface.

6. The filling device according to claim 1, wherein the control system comprises a valve rod extending substantially axially in the tubular body, the central valve being mounted at the lower end of the valve rod, the main valve being assembled to a bushing mounted slidingly on the valve rod between said central valve and a shoulder of said rod, a spring being mounted between the bushing and said shoulder in order to elastically solicit said bushing in the direction of the central valve, and a control member able to displace the valve rod between a low position wherein the central valve is in its closed position and the main valve is elastically solicited by the spring in its closed position, an intermediary position wherein the central valve is in an open position and the main valve is elastically solicited by the spring in its closed position, and a high position wherein the central valve is in an open position in abutment against the bushing and the main valve in open position.

7. The filling device according to claim 1, wherein said radial grooves and an annular space proximate to said radial grooves are sized to define a retention volume, wherein said retention volume is configured to contain said filling product.

8. The filling device according to claim 1, wherein said radial grooves comprise at least one first groove and at least one second groove, said at least one second groove being of a smaller dimension than said at least one first groove.

* * * * *